United States Patent [19]

Tsuyama

[11] 3,945,675

[45] Mar. 23, 1976

[54] BLOCK LOADER

[75] Inventor: Yoshizo Tsuyama, Nara, Japan

[73] Assignees: Nippon Kokan Kabushiki Kaisha, Tokyo; Eagle Clamp Co., Ltd., Nara, both of Japan

[22] Filed: June 27, 1974

[21] Appl. No.: 483,684

[30] Foreign Application Priority Data

May 30, 1974 Japan ..... 49-62975[U]
May 30, 1974 Japan ..... 49-62976[U]
May 30, 1974 Japan ..... 49-62977[U]

[52] U.S. Cl. ..... 294/81 R; 294/67 R; 294/86 R
[51] Int. Cl.[2] ..... B66C 1/12
[58] Field of Search ..... 294/67 R, 67 BB, 67 DA, 294/78 R, 78 A, 81 R, 81 SF, 86 R, 86 LS; 212/11–14, 45, 75, 80, 82, 85, 89, 99, 125, 128; 254/83, 135 CE, 139.1, 144, 168, 172, 178, 188, 189

[56] References Cited

UNITED STATES PATENTS

| | | | |
|---|---|---|---|
| 566,849 | 9/1896 | Dusedau | 212/80 X |
| 897,040 | 8/1908 | Wash | 254/135 CE X |
| 926,982 | 7/1909 | Graham | 254/135 CE X |
| 930,541 | 8/1909 | Frazee | 254/83 |
| 2,063,915 | 12/1936 | Fitch | 212/14 X |
| 2,811,262 | 10/1957 | Schaitberger | 254/168 X |
| 3,536,350 | 10/1970 | Backteman | 294/81 R X |
| 3,558,176 | 1/1971 | Fathauer et al. | 294/81 SF X |
| 3,596,970 | 8/1971 | Levert et al. | 294/81 R X |
| 3,610,673 | 10/1971 | Strombeck et al. | 294/81 R X |
| 3,805,967 | 4/1974 | Scannell | 212/14 |

*Primary Examiner*—Evon C. Blunk
*Assistant Examiner*—Johnny D. Cherry
*Attorney, Agent, or Firm*—Kurt Kelman

[57] ABSTRACT

There is provided a loader which is well suited for lifting heavy weight blocks and which is thus particularly advantageously usable in the assembling of blocks for building a ship. The loader body includes at least one beam arranged in a horizontal plane, and a plurality of separate pulley means are directly or indirectly mounted on the loader body in such a manner that these pulley means are arranged fixedly or movable to adjust the distance therebetween, whereby even when the center of gravity of a block is not in alignment with the center of the loader, the block can be lifted easily.

9 Claims, 27 Drawing Figures

B
C
C
B
2
3
4
5
6
8
11
12
13
15
18
19
20
21
22

BLOCK LOADER

BACKGROUND OF THE INVENTION

Field of the Invention

The present invention relates to a loader of the type which is used with a crane for lifting and moving heavy weights, and more particularly the present invention relates to a loader which is well suited for lifting blocks in ship construction.

Presently, those blocks assembled in a factory for building ships show a tendency to become heavier and heavier and their weights are now over several hundreds tons. To lift such a heavy block by means of a crane, a large number of eye-pieces are welded first to the block, and the other ends of a large number of wire ropes linked at one ends to these eye-pieces are hung on a hook or hooks of the crane to lift the block. In this lifting operation, it is essential to make the necessary adjustments of the wires so that when the block is lifted the load on each of the wires is the same. In the past, however, such a lifting operation was a very difficult operation and was also attended with danger.

Generally, when lifting blocks by a crane in a shipyard, it has been the practice to attach an eye-piece to each of practically the four corners of blocks of many different shapes and the respective wire ropes fastened to these eye-pieces are brought together at a point on the crane to lift the blocks.

In case of a four-point hanging method in which a block is lifted by means of four wires fastened to the eye-pieces welded to the four corners of the block, at least one fourth of the weight of the block must be supported by the hanger, such as, a shackle attached to the end of each of the wire ropes fastened to the respective eye-pieces, and one fourth of the weight of the block is supported by each wire rope. Consequently, the hanger for supporting one fourth of the weight of a block which is generally a heavy weight material must be made bulky and strong, and the diameter of the wire ropes must be correspondingly large. In addition, it is essential that the eye-pieces are positively attached to a block at the correct positions so that the weight of the block is evenly distributed to the eye-pieces and that the block is made strong enough or reinforced so that the block is not distorted or deformed when it is lifted by means of the eye-pieces.

As a matter of fact, eye-pieces are welded to a block when it is to be lifted and moved from a factory to a dock or when it is to be lifted for assembling work in a dock, and the eye-pieces are removed after the completion of the operation. The material used for the eye-pieces and the labor required for their welding can be considerably reduced by using clamps in place of the eye-pieces. However, for lifting a heavy weight block, e.g., a block which is so heavy that the load acting at each hanging point is greater than 50 tons, a large clamp must be used at each hanging point whose weight is so large that it is difficult to manually operate it. Therefore, to lift heavy blocks which have recently been tending to become heavier and heavier, it is preferable that the number of hanging points is increased to reduce the bearing weight at each hanging point and at the same time measures are taken to eliminate the use of eye-pieces and permit the use of clamps.

In the actual lifting operation of blocks, however, it is not an easy matter to compute the center of gravity of a block and select the position of the clamps so that the weight of the block is equally distributed to a large number of hanging points.

In case of a four-point hanging of a block, the block is lifted slightly as a preliminary operation by means of the wire ropes fastened to the computed hanging points, and the actual lifting of the block is effected only after the skilled operator has confirmed through the preliminary lifting that the load acting on each of the hanging points is the same. The problem is more complicated in the case of mutiple-point lifting of blocks employing more than four hanging points, and there is no insurance that the load of a block can be uniformly distributed to such a large number of hanging points. Therefore, in the presently known arrangements for such multiple-point hanging, a number of balances are arranged in a pyramidal form (a treelike form) in which a pair of balances is suspended from the preceding balance at the ends thereof and in this way the load at each of the multiple hanging points is balanced, or alternately the balances in the tree are replaced with pulleys to balance the load at each of the multiple hanging points.

A disadvantage of these known loaders of the tree configuration is that the loader tends to become long in length and bulky, difficult to operate and more troublesome for maintenance.

The inventors have developed a block loader in which the welding of eye-pieces to a block is eliminated to reduce the labor required for lifting the block and in which a single wire is passed alternately over a large number of movable pulleys arranged in the same plane and a large number of stationary pulleys mounted on the loader proper to accurately distribute the same load to each of the hanging points. In this loader, the movable pulleys are arranged in a row or rows with each row including an odd number of the movable pulleys, and all the movable pulleys are interconnected by a single wire rope passed thereover so that the loader is available for operations ranging from a single-point hanging to a multiple-point hanging equal to the number of the movable pulleys used. In this way, the number of hanging points can be suitably selected in accordance with the shape of a block and at the same time the load can be equally distributed to each of the hanging points without any particular consideration. Thus, this block loader made a great contribution toward solving the operating difficulties encountered in the conventional apparatus.

This block loader is also disadvantageous in that if, for example, more than 30 movable pulleys are used, the frictional resistance between the wire rope and the pulleys is accumulated locally and hence an excessive load acts on a small number of the pulleys.

On the other hand, in a shipyard the individual blocks are usually assembled on a building berth having a certain berth declivity, and therefore it is essential that the block lifted from its horizontal position is brought into an inclined position corresponding to the berth declivity and it is then lowered onto the building berth in this inclined condition. However, with the block loader of the above-described type, the pulleys operate in such a manner that the uniform load always acts on each pulley and thus it is impossible to bring the block into such an inclined position. Further, due to the similar principles, if the center of gravity of the block is not in alignment with the center of the block loader, it is impossible to lift the block into a horizontal position and it is also impossible to adjust the inclination of the block while it is lowered onto the building berth. These deficiencies necessarily mean that the block loader requires the use of necessary auxiliary lifting devices.

SUMMARY OF THE INVENTION

With a view to overcoming the foregoing difficulty of the block loader of the type which was developed by the inventors and in which the load is equally distributed to all of the hanging points, it is an object of the present invention to provide an improved block loader in which a large number of movable pulleys are arranged into a plurality of groups, whereby the load on each of the movable pulleys in each group is made the same.

It is another object of the present invention to provide a block loader in which the position of movable pulleys is adjustable in accordance with the shape of a block to be lifted, so that multiple-point hanging of blocks is made possible irrespective of the shape of the blocks.

In accordance with the present invention, there is thus provided a block loader comprising a plurality of stationary pulleys directly rotatably mounted on a beam, a wire rope fastening pin at each end of the beam and at each of selected positions therebetween, and a plurality of wire ropes. Between each pair of the wire rope fastening pins which are arranged with space therebetween, the wire rope is passed over the plurality of the stationary pulleys located between the pins in such a manner that a loop of the depending wire rope is formed between the pin and the stationary pulley and between the stationary pulleys. Further comprised is a movable pulley arranged at each loop portion so that the movable pulleys are raised and lowered in accordance with the increase and decrease in the length of the loop portions. In this way, a group of the movable pulleys engaging with the single wire rope is directly arranged on the beam so that the load is equally distributed to the movable pulleys in the group. A second group of the similar movable pulleys is provided on the same beam or another beam connected with the first beam in the same horizontal plane, and in this way the loader body comprising one or plurality of the beams is provided with the movable pulleys formed into groups, i.e., a plurality of separate pulley means.

It will thus be seen that the body portion of the block loader according to the invention may be comprised of a single beam or it may be comprised of two or more beams which are arranged in juxtaposition or in a frame form. When the body portion of the block loader is comprised of a plurality of beams, each beam may be provided with a single group of movable pulleys or two or more groups of movable pulleys.

According to another form of the invention, at least one groups of movable pulleys is directly provided on each of two or more beams arranged in juxtaposition, and the beams are interconnected by extendible means which may be telescopic or pantagraphic mechanism.

According to still another form of the present invention, instead of providing a group or groups of movable pulleys on a beam, a carrier movable along the beam is provided with at least one group of movable pulleys, and a plurality of such carriers are provided on the same beam or alternately at least one such carrier is provided on each of a plurality of beams.

In the operation of the block loader of this invention, all of the movable pulleys need not be used as hanging points and the movable pulleys may be suitably selectively used in accordance with the state of balance between the block loader and a block to be lifted. In this case, the movable pulleys which are not used as hanging points may be pulled upward or toward the beam by the tension of the wire rope pulled by the movable pulleys used as hanging points, so that the stopper of each movable pulley comes into contact with the seating plate or engaging plate provided on the lower surface of the beam or the lower surface of the carrier and thus the movable pulley is held as if it were secured to the beam or carrier, thus allowing only the wheels of these movable pulleys to rotate and causing the movable pulleys to function in the same manner as the stationary pulleys.

In summary, in accordance with the present invention, a block loader is provided comprising a loader body consisting of one or plurality of beams arranged in a horizontal plane, and at least one pulley means or at least one group of movable pulleys directly or indirectly provided on the beam, whereby the weight of a block to be lifted is equally distributed to the plurality of movable pulleys in one or plurality of groups which are arranged in a horizontal plane.

The foregoing and other objects, features and advantages of the present invention will be apparent from the following more particular description of the preferred embodiments as illustrated in the accompanying drawings.

BRIEF DESCRIPTION OF THE DRAWING

FIGS. 3, a, 4*b*, 4*c*, 4*d* and 4*e* show a modified form of the double-beam type block loader of FIG. , with FIG. 4*a* showing its plan view, FIG. 4*b* showing its front view, FIG. 4*c* showing its side view, FIG. 4*d* showing means for connecting the pair of beams in the block loader to be movable breadthwise, and FIG. 4*e* showing the pair of beams which are near together with the minimum space therebetween.

DESCRIPTION OF THE PREFERRED EMBODIMENTS

Figure 1A:
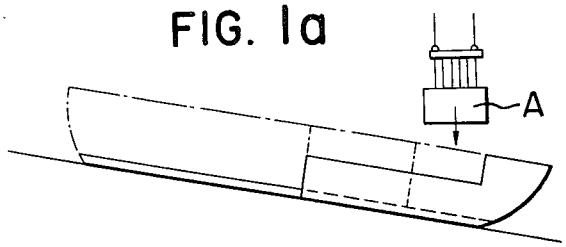
FIGS. 1*a*, 1*b* and 1*c* are schematic diagrams which are useful in explaining the advantages of a block loader according to the present invention over prior art devices.

When assembling a block A manufactured in a factory into a hull construction in a dock, as will be seen from FIG. 1*a*, it is necessary to incline the block A according to the berth declivity and lower it in this inclined position.

Figure 1B:
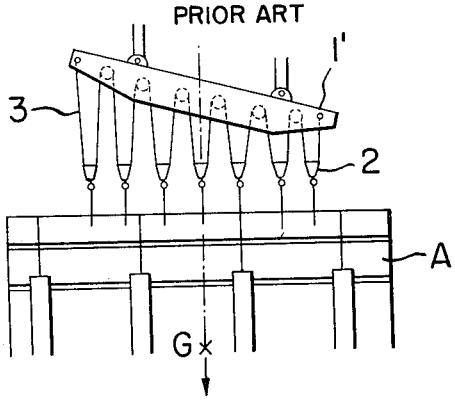
FIG. 1b PRIOR ART

FIG. 1*b* shows the manner in which a conventional block loader is operated to bring the block A into such an inclined position. As mentioned earlier, the conventional block loader comprises a beam-type or frame-type loader body 1′ from which a plurality of movable pulleys 2′ are suspended by a wire rope 3′. Consequently, when the block A which is assumed to be a perfectly rigid body is lifted and moved into the dock, the center G of gravity of the block A is located in the center perpendicular line of the block loader. This permits the block A to be lifted into a horizontal position. Assuming now that the block loader is inclined to bring the block A suspended therefrom into an inclined position, the center G of gravity of the block A tends to deviate from the center perpendicular line. In this case, the direction of deviation of the center G of gravity is such that, when the portion of the block on the left side of the block loader in FIG. 1*b* is to be pulled up, the center G deviates to the left side of the perpendicular line. This deviation of the center G from the perpendicular line naturally increases the load acting on the movable pulleys arranged to the left of the center of the block loader and decreases the load acting on the movable pulleys arranged to the right of the center of the block loader. This difference in the loads acting on the movable pulleys is properly balanced by the normal function of the block loader. In other words, the center G of gravity of the block A is restored to the position in the center perpendicular line of the block loader. Namely, the movable pulleys 2′ move along the wire rope 3′ from equidistant positions below the block loader body 1′ to new positions below the block loader proper 1′ which are not equidistant as shown in FIG. 1*b*. In conclusion, if the friction of the loader is neglected, the conventional block loader cannot bring the block into the desired inclined position when the block loader is inclined for that purpose. Therefore, in order to bring the block into the desired inclined position, it is essential to use an auxiliary lifting device.

Figure 1C:
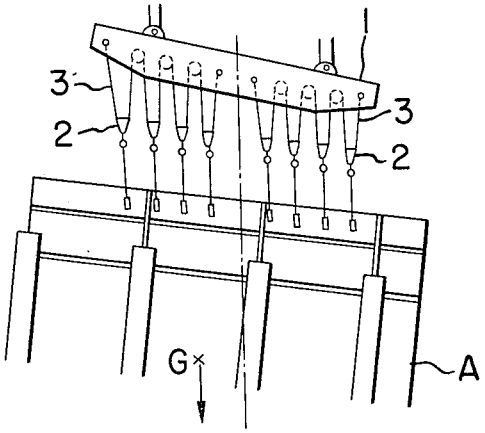

With a block loader according to the present invention, a lifted block can be inclined as desired by means of the block loader alone without employing any auxiliary lifting device. FIG. 1*c* illustrates the manner in which the block A is brought into an inclined position by the block loader of this invention. Assume now that the block A is lifted to a horizontal position so that the center G of gravity of the block A is located on the center perpendicular line of the block loader. In this case, it should of course be understood that a block loader body 1 was initially placed in a horizontal position. Thereafter, when the loader body 1 is inclined as shown in FIG. 1*c* to incline the block A, the center G of gravity of the block A deviates to the left in the illustration from the perpendicular line. However, with the block loader of this invention, movable pulleys 2 do not move along a wire rope 3 to bring the center G of gravity back onto the perpendicular line of the loader body. This results from the fact that a group of the movable pulleys arranged to the left of the center of the loader body and another group of the movable pulleys arranged to the right of the center of the loader body are suspended therefrom by separate wire ropes 3. In other words, the block loader of this invention is provided, though relatively small in number, with a plurality of groups of movable pulleys and the load balancing action does not take place between the groups of the movable pulleys.

Preferably, if it is intended to lower the block A in its inclined position in the manner described above, preferably the block A should be lifted into a horizontal position so that the center G of gravity of the block A in FIG. 1*c* is positioned to the right of the perpendicular line of the loader body and then the center G is moved to the left of the perpendicular line as the block A is lowered. This permits the use of a smaller block loader to provide the same desired operation.

The above-described novel feature of the present invention also has the effect of considerably improving the operating efficiency of the block loader in the simple operation of lifting and lowering blocks. In the case of the conventional block loader shown in FIG. 1*b*, it is impossible to lift a block into a horizontal position unless the center of gravity of the block is accurately located in the center perpendicular line of the loader. On the contrary, with the block loader according to the present invention, it is possible to lift a block horizontally without accurately locating the center of gravity of the block in the center perpendicular line of the loader. This novel feature is particularly useful for lifting blocks which are unsymmetrical in both longitudinal and transverse directions permitting the use of only a limited number of hanging points. The block loader of this invention is also useful in lifting blocks which are not perfectly rigid bodies and which are thus subject to deflection. The feature that the movable pulleys are formed into a plurality of groups is also significant since it permits novel arrangements of the block loader in which, as will be described later, the distance between the two beams constituting a loader proper is made adjustable or alternately the distance between the respective groups of movable pulleys is adjustable through the use of carriers.

Figures 2A, 2B:
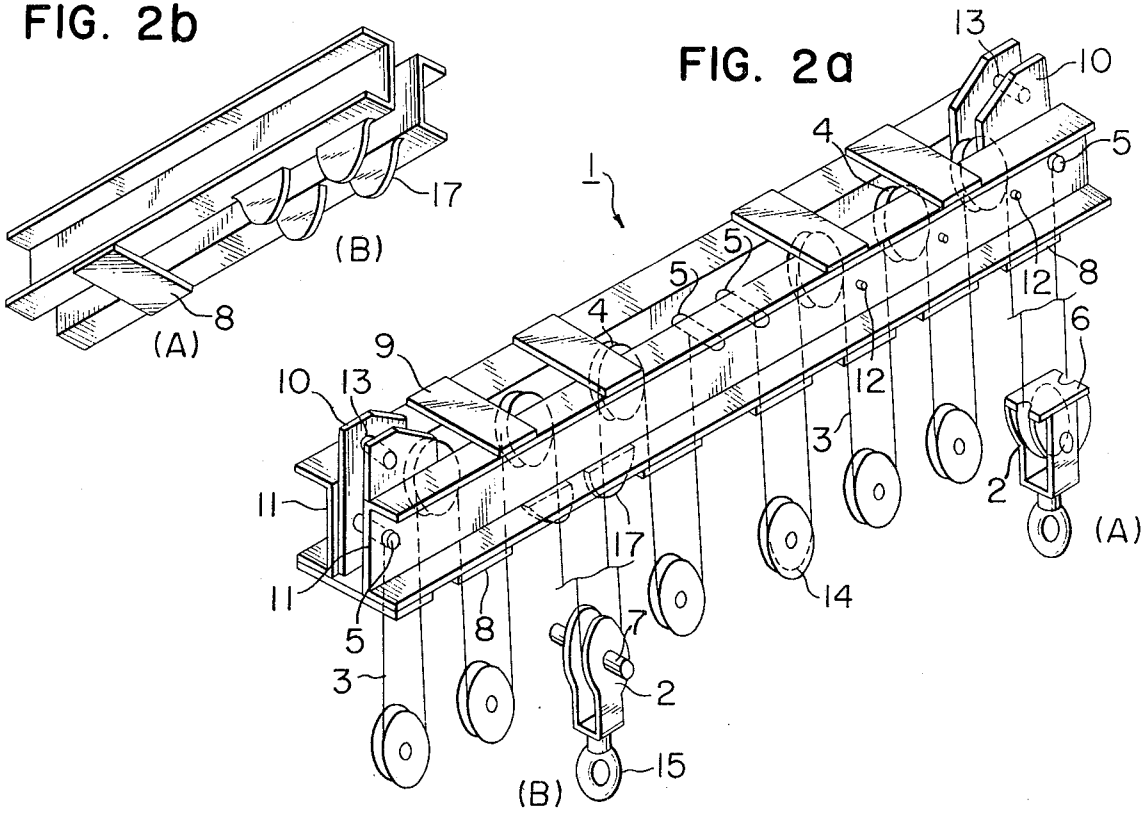
FIG. 2*a* is a perspective view of a first embodiment of a single-beam type block loader according to the invention, in which movable pulleys are formed into two groups.
FIG. 2*b* is a partial perspective view of the embodiment of FIG. 1 showing a seating plate or engaging plates provided on the lower surface of a beam to come into contact with the stopper mounted on a movable pulley when the latter is raised by the tension of a wire rope.

Referring now to FIG. 2*a* showing a specific embodiment of the invention, reference numeral 1 designates generally a loader body or beam of a block loader according to the invention, which comprises a pair of channel members 11. Disposed between the pair of channel members 11 are a plurality of stationary pulleys 4 which are arranged in a line at regular intervals and each of the stationary pulleys 4 is rotatably mounted on the beam loader body 1 by axle 12. The channel members 11 are connected together by a plurality of seating plates 8 which are welded across the lower flanges of the channel members 11 and a plurality of seating plates 9 which are welded across the upper flanges of the channel members 11. The beam loader body 1 is provided at each end thereof with a pair of eye plates 10 welded to the web portions of the channel members 11, and disposed to extend through each pair of the eye plates 10 is a hanger pin 13 on which is wound a wire rope for connecting the block loader to the hook of a crane. In the illustrated embodiment, six stationary pulleys 4 are provided, and a total of four fastening pins 5 are provided on the loader body 1, i.e., one at each end thereof and the other two are arranged on the central portion thereof. One wire rope 3 is fastened at one end thereof to the wire rope fastening pin 5 at one end of the loader body 1 and it is then passed successively over the stationary pulley 4 closest to this pin 5, over the stationary pulley 4 adjacent to the first one and so on, thus forming loops 14 of the depending wire rope 3 between the stationary pulleys 4. A movable pulley 2 is suspended on each loop portion and then the other end of the one wire rope 3 is fastened to one of the fastening pins 5 at the central portion of the loader body 1. Another wire rope 3 is similarly passed over stationary pulleys 4 between the fastening pin 5 at the other end of the loader body 1 and the other of the centrally located pins 5, so that one movable pulley 2 is similarly suspended on each of the similarly formed loops of the other wire rope 3. In this way, two groups of the movable pulleys are formed on the beam. The wire rope fastening pins 5 may be replaced with means for suitably taking up and locking the wire ropes 3 on the loader body 1 or by other means for locking the single wire rope 3 which is commonly used by the two groups of the movable pulleys. As customary, a hanger ring 15 is rotatably mounted below each movable pulley 2.

The single-beam type block loader shown in FIG. 2*a* is provided with eight movable pulleys 2 and it is capable of providing 2-point hanging, 4-point hanging, 6 -point hanging and 8-point hanging. In operating the block loader, a wire rope is wound around the shafts of the hanger pins 13 and the wire rope is hung on the hook of a crane, for example. For lifting a block with four hanging points, two of the movable pulleys in each group are suitably selected and a clamp (not shown) provided at the end of a wire rope fastened to the hanger ring 15 at the end of each movable pulley is attached to each of the hanging points on the block. When the hook of the crane is pulled up in this condition, the movable pulleys which are not in operation are pulled upward or toward the loader body 1 by the tension of the wire ropes 3 caused by the pulling down of the loops by the movable pulleys in operation. Each of the movable pulleys is provided with an abutment 6 mounted on the upper portion thereof so that, when the movable pulley is pulled up as described above, abutment 6 comes into contact with the seating plate 8 welded across the lower flanges of the beam 1*a* and securely holds the movable pulley against the loader body 1. In this manner, the movable pulleys which are not used for lifting purposes are still in engagement with the wire rope 3 and are thus rotated to function in the same manner as the stationary pulleys 4 mounted on the body portion 1. This securing of the movably pulley against the body portion 1 may also be effected by extending the shaft of the movable pulley, as shown at 7 in FIG. 2*a*, and by providing a pair of guide plates 17 on the lower flanges of the channel members 11 to define a space into which the engaging shaft portion of the movable pulley is guided and held stationary. FIG. 2*b* illustrates the manner in which the seating plate 8 and the guide plates 17 may be respectively mounted on the lower flanges of the channel members 11. The seating plate 8 engages with the movable pulley of the type shown at (A) in FIG. 2*a*, while the guide plates 17 engage with the movable pulley of the type shown at (B) in FIG. 2*a*. In the subsequent figures showing further embodiments, like reference numerals designate like parts functioning in a like manner.

Figure 3:
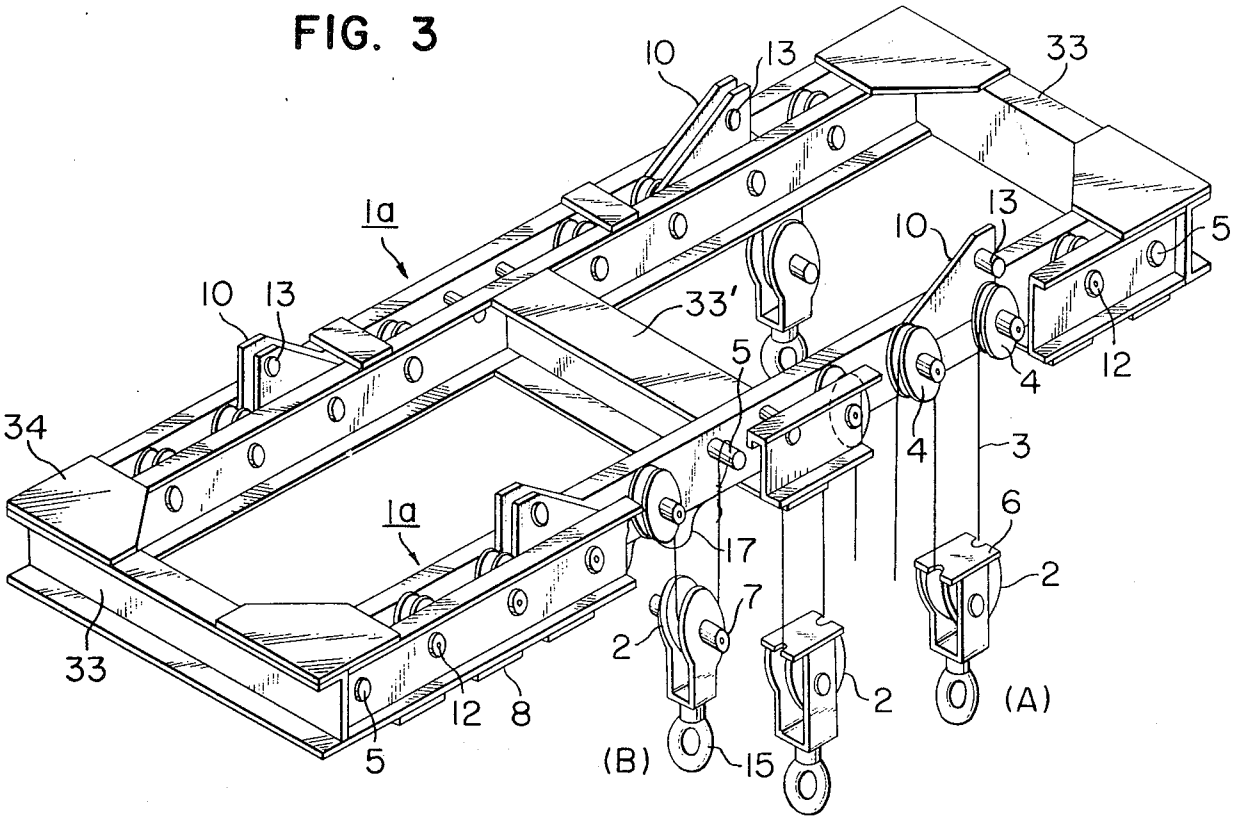
FIG. 3 is a perspective view of a second embodiment of a double-beam type block loader, in which movable pulleys are formed into four groups.

FIG. 3 illustrates a second embodiment of a double-beam type block loader comprising a frame-type loader body 1*a* composed of two units of the beam-type loader body shown in FIG. 2*a* and which are interconnected in juxtaposition. The beams are connected together by means of a channel member 33 welded to each end of the beams, an I-shaped member 33' welded to the central portions of the beams and corner plates 34 welded to the corners of the frame. Thus, in the second embodiment, a total of four groups of movable pulleys, i.e., two groups for each beam, are arranged in the same horizontal plane. With the four groups of the movable pulleys arranged in the same horizontal plane as shown in FIG. 3, the block loader of the second embodiment is well suited for lifting horizontally with greater operating stability those blocks which are unsymmetrical both in longitudinal and crosswise directions.

FIGS. 4 through 6 illustrate modified forms of the double-beam type block loader shown in FIG. 3, which differ from the latter in that telescopic or extendible connecting means are used for interconnecting the beams in place of the connecting members of fixed length.

In the modification shown in FIGS. 4*a* through 4*e*, two beams 1*a* are interconnected by means of internally threaded cylinders 36 and male screws 35 which are fitted in the cylinders 36 so that the distance between the beams 1*a* may be adjusted as desired. A connecting member 37 provided at each end of the frame-type loader body is a telescopic type reinforcement and guide member.

The distance between the two beams is determined in accordance with the position of hanging points on a block to be lifted, and the selection of the movable pulleys to be used is effected for each group.

To adjust the distance between the beams, one of the beams 1*a* is provided with a chain block to turn the male screws 35. As will be seen from FIG. 4*b*, an operating chain 38 is wound around a sprocket 39 so that the sprocket 39 is driven in a clockwise or counterclockwise direction as the operating chain 38 is pulled. When the sprocket 39 is driven counterclockwise, each of the male screws 35 is turned counterclockwise by a chain 41 and sprocket 42 mounted on the shaft of each male screw 35 and in this way the width of the frame loader body is reduced.

A wire rope is fastened to the hanger ring 15 at the end of each of the movable pulleys 2 selected for block lifting purposes in each group, and a clamp provided at the other end of each wire rope is fastened to the block.

Figure 4C:
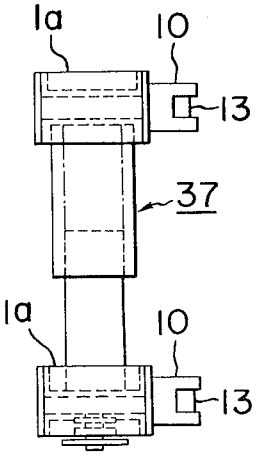
Figure 4A:
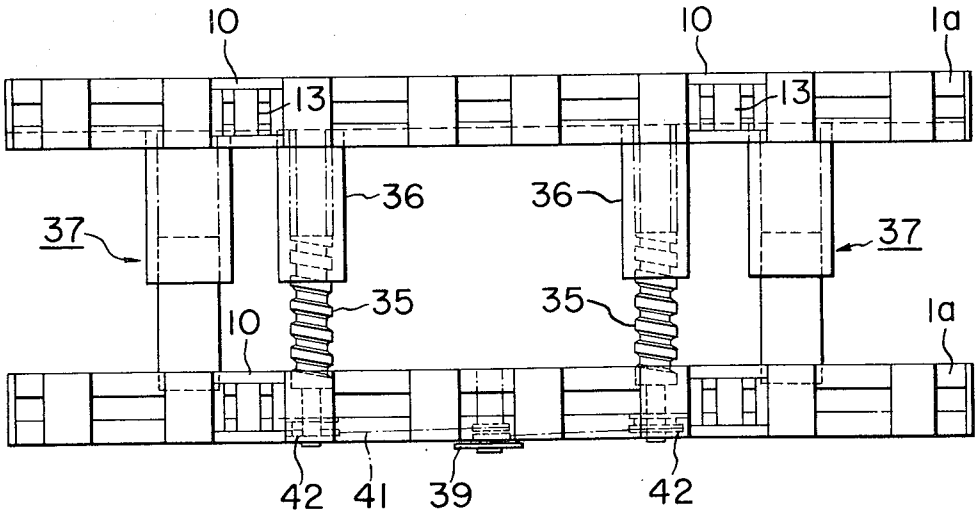
Figure 4B:
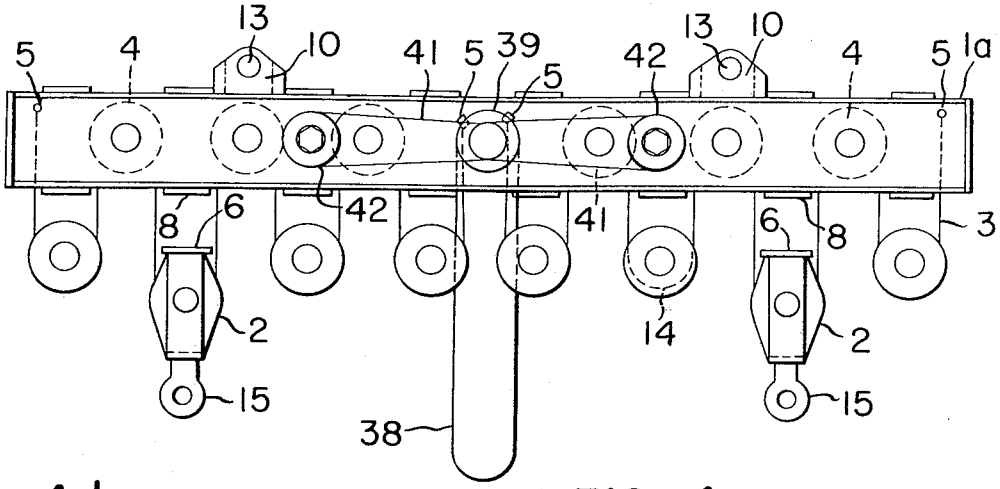
Figure 4E:
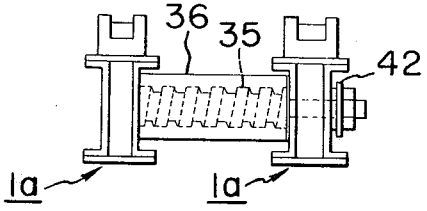
Figure 4D:
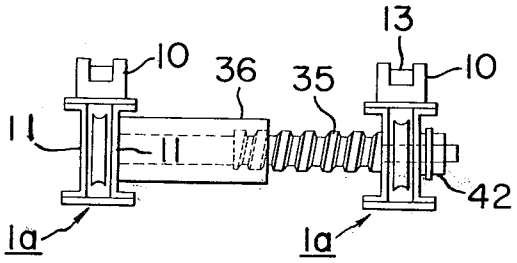

FIG. 4*c* is a left side view of FIG. 4*a*, showing the construction of the connecting means provided at each end of the loader body. FIGS. 4*d* and 4*e* show the construction of the connecting means provided at the central portion of the loader body. When the connecting means is contracted, as shown in FIG. 4*e*, so that the beams are pulled closer to each other, the corresponding movable pulleys on the two beams 1*a* may be combined together to use the block loader in the similar manner as the single-beam type block loader.

It will thus be seen that in the embodiment shown in FIGS. 4*a*–4*e*, each beam is provided with two groups of the movable pulleys and therefore the block loader according to this embodiment is capable of readily determining the necessary hanging points on any blocks which are unsymmetrical both in longitudinal and crosswise directions. Any unbalanced distribution of the load among the respective groups can be adjusted by the fact that the load acting on each group is distributed and born by the plurality of the movable pulleys 2 in each group. In this way, the block loader of this embodiment can lift blocks horizontally with a higher degree of safety as compared with the conventional multiple-point hanging with separate movable pulleys.

Figure 5C:
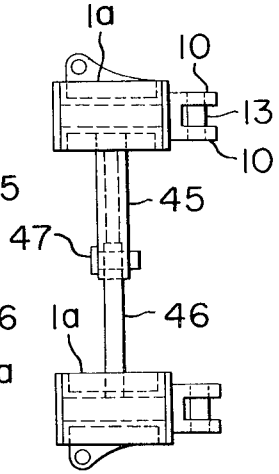
FIGS. 5*a*, 5*b*, 5*c*, 5*d* and 5*e* are diagrams which are similar respectively to FIGS. 4*a* through 4*e*, showing another modification of the double-beam type block loader of FIG. 3.
Figure 5A:
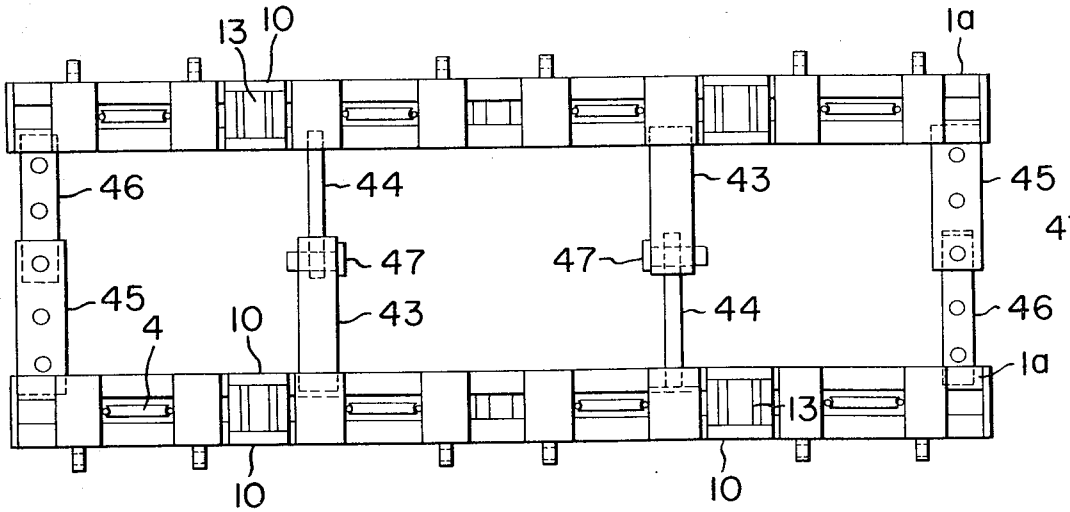
Figure 5B:
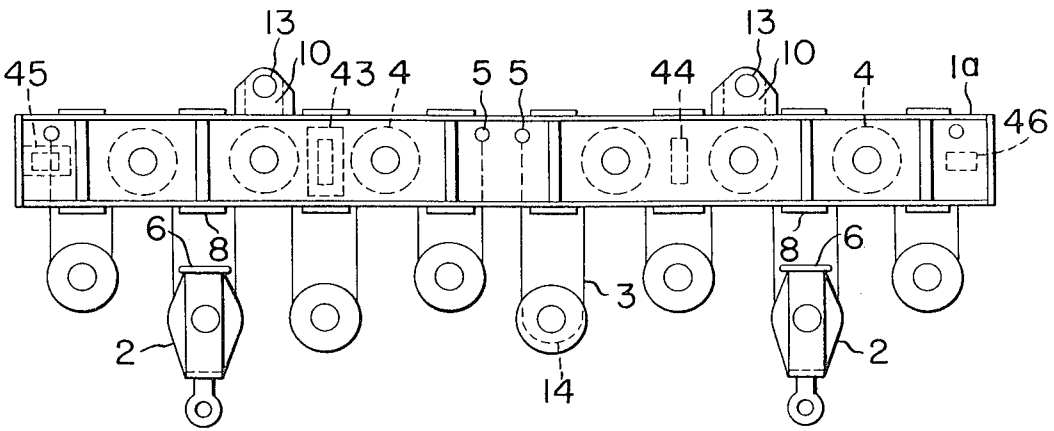
Figure 5E:
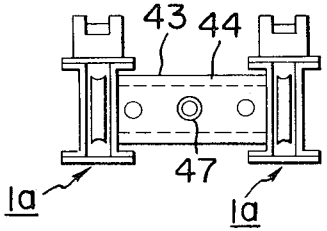
Figure 5D:
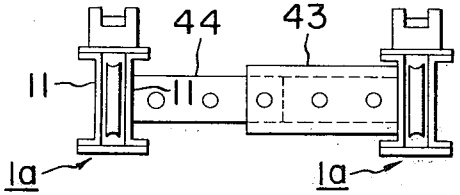
Figure 6C:
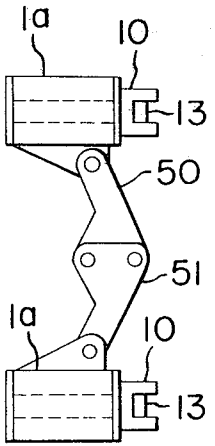
FIGS. 6*a*, 6*b*, 6*c*, 6*d* and 6*e* show still another modification of the double-beam type block loder of FIG. 3, with FIG. 6*a* showing its plan view, FIG. 6*b* showing its front view, FIG. 6*c* showing a side view of FIG. 6*a* taken along the arrow *c—c*, FIG. 6*d* showing a side view of FIG. 6*a* taken along the arrow *d—d*, and FIG. 6*e* showing the connecting means of FIG. 6*d* in its contracted position.
Figure 6A:
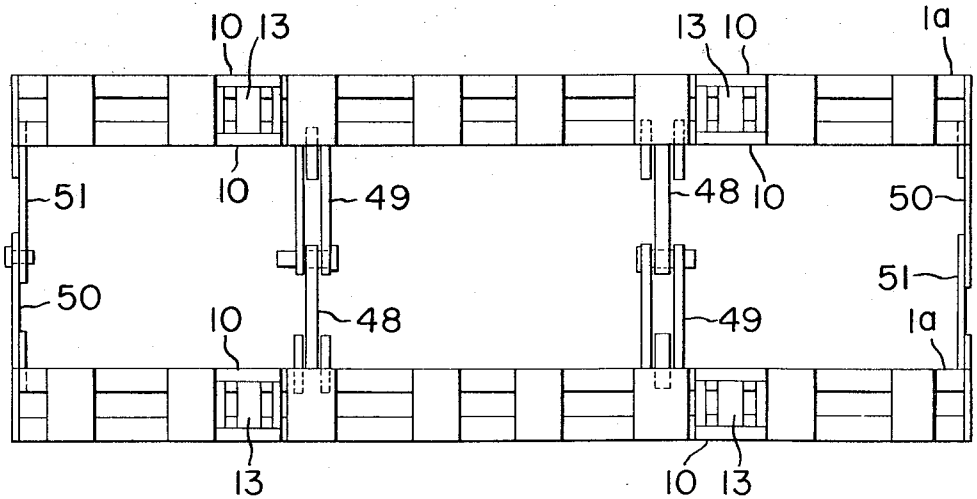
Figure 6B:
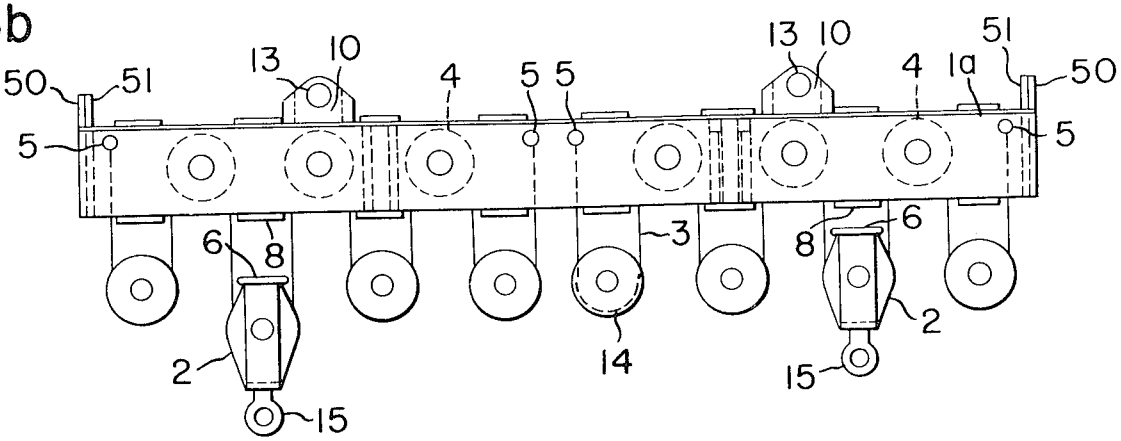
Figure 6E:
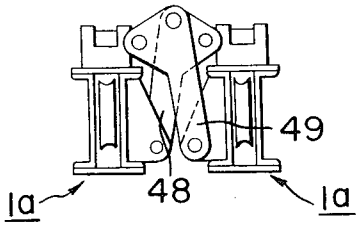
Figure 6D:
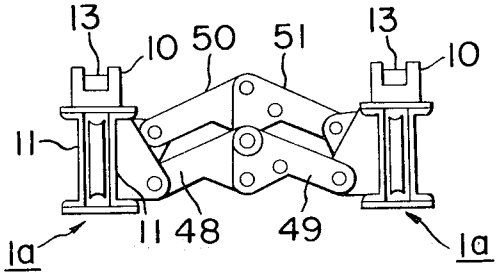

In the embodiment shown in FIGS. 5*a* through 5*e*, the respective beams constituting a frame loader body are interconnected with four connecting means, that is, the beams are extendibly interconnected by square cylinders 43 and 45 and plate members 44 and 46 which are telescopically fitted into one another. Of these connecting means, the centrally located two connecting means are perpendicular to the other two connecting means at the ends of the frame loader body, as shown in FIG. 5*b*. In this manner, the frame loader body is held against deformation of the frame as a whole. The adjusted distance between the beams 1*a* is locked by means of pins 47.

In the embodiment shown in FIGS. 6*a* to 6*e*, similarly as the previously described embodiments, the two beams 1*a* are interconnected by means of four pantagraph-type connecting means. With link plates 48, 49 and 50, 51 pivoted at the ends thereof to the beams 1*a*, the beams 1*a* may be held at a distance corresponding to any one of three different settings. Similarly as the connecting means used in the embodiment of FIGS. 5*a*–5*e*, the central connecting means are secured to the lower portions of the beams 1*a* and the connecting means at the ends of the frame loader body are secured to the upper portions of the beam 1*a*, thereby preventing distortion of the frame.

Figures 7A, 7C:
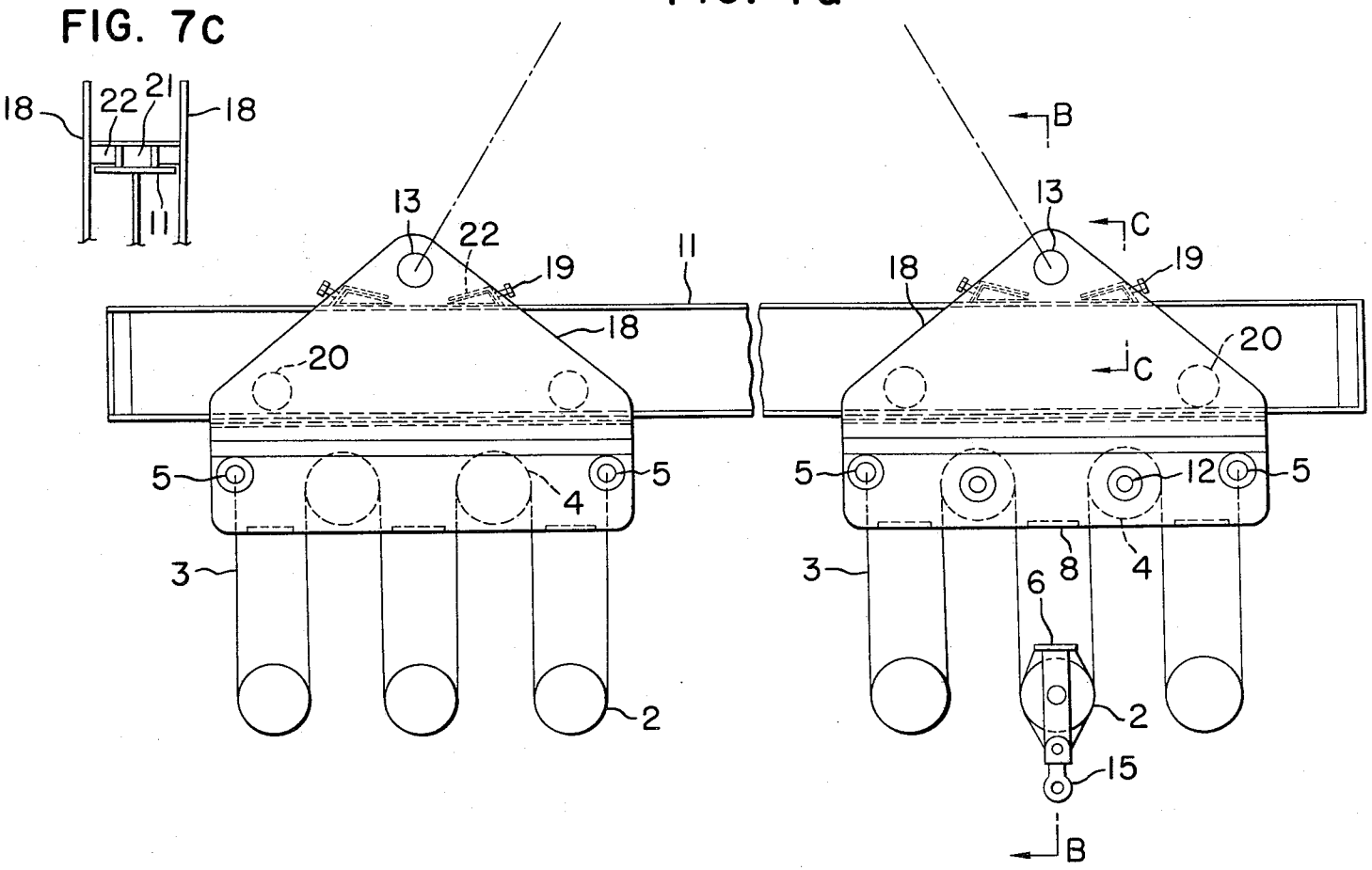
FIGS. 7*a*, 7*b*, 7*c* and 7*d* show a modified form of the single-beam type block loader of FIG. 2*a*, with FIG. 7*a* showing its front view, FIG. 7*b* showing a sectional view taken along the line *b*—*b* of FIG. 7*a*, FIG. 7*c* showing a sectional view taken along the line *c*—*c* of FIG. 7*a* and FIG. 7*d* showing an enlarged sectional view of the wedge for securely fastening the carrier to the loader body.
Figure 7B:
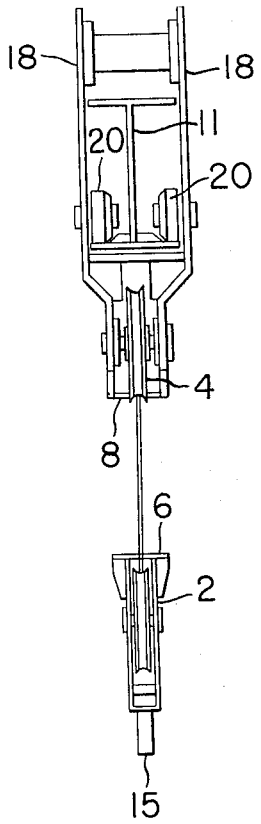

Referring now to FIGS. 7*a* through 7*d*, there is illustrated a modified form of the single-beam type block loader. As will be seen from FIG. 7*a*, the body of the block loader comprises a single beam 11 and two carriers movable along the beam 11. The beam 11 is comprised of an I-shaped member, as shown in FIG. 7*b*, and each of the carriers is comprised of a pair of opposed triangular plates 18 externally surrounding the beam 11. Each of the triangular plates 18 is provided with a pair of transport rollers 20, and a plurality of stationary pulleys 4 are arranged in a line at regular intervals between the respective pair of the triangular plates 18 at the base portions thereof. Each of the stationary pulleys 4 is rotatably carried on the triangular plates 18 by axle 12. The triangular plates 18 of each carrier are interconnected by a seating plate 8 welded to extend across the lower edges thereof and a hanger pin 13 mounted to extend through the triangular plates 18 near the upper ends thereof. In the illustrated embodiment, the carriers are respectively provided with two stationary pulleys and, as in the embodiment of FIGS. 2*a*–2*l*, a single wire rope 3 is passed from a pin 5 at one end of the carrier over the two stationary pulleys to another pin 5 at the other end of the carrier, so that a total of three movable pulleys 2 are suspended on the loops of the depending wire rope 3. In this way, each of the carriers is provided with a group of the movable pulleys 2 by which the weight of a block to be lifted is equally shared.

Figure 7D:
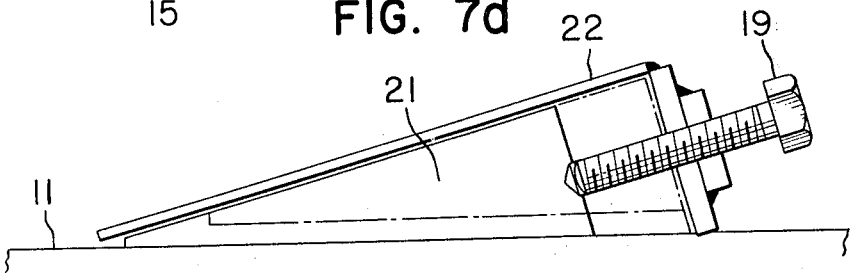

The mounting of the carrier on beam 11 is accomplished by means of the members shown in FIGS. 7*c* and 7*d*, i.e., guide plates 22 and wedges 21 which are respectively mounted between the upper flanges of the beam 11. In other words, as shown in FIG. 7*d*, the carrier is fixedly mounted on the beam 11 by locking with a bolt 19 each of the wedges 21 in the associated guide plate 22 in the position shown by the solid lines in FIG. 7*d*. In the block loader shown in FIG. 7*a*, the position of the movable pulley groups or the position of hanging points can be varied by moving the carriers in the longitudinal direction of the beam 11.

Figure 8B:
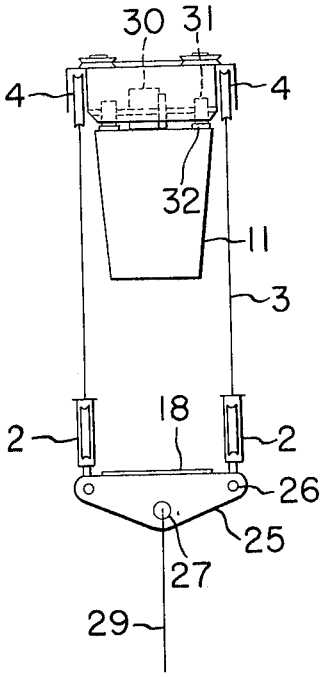
FIGS. 8*a* and 8*b* show another modification of the single-beam type block loader of FIG. 2*a*, with FIG. 8*a* showing its front view and FIG. 8*b* showing its side view.
Figure 8A:
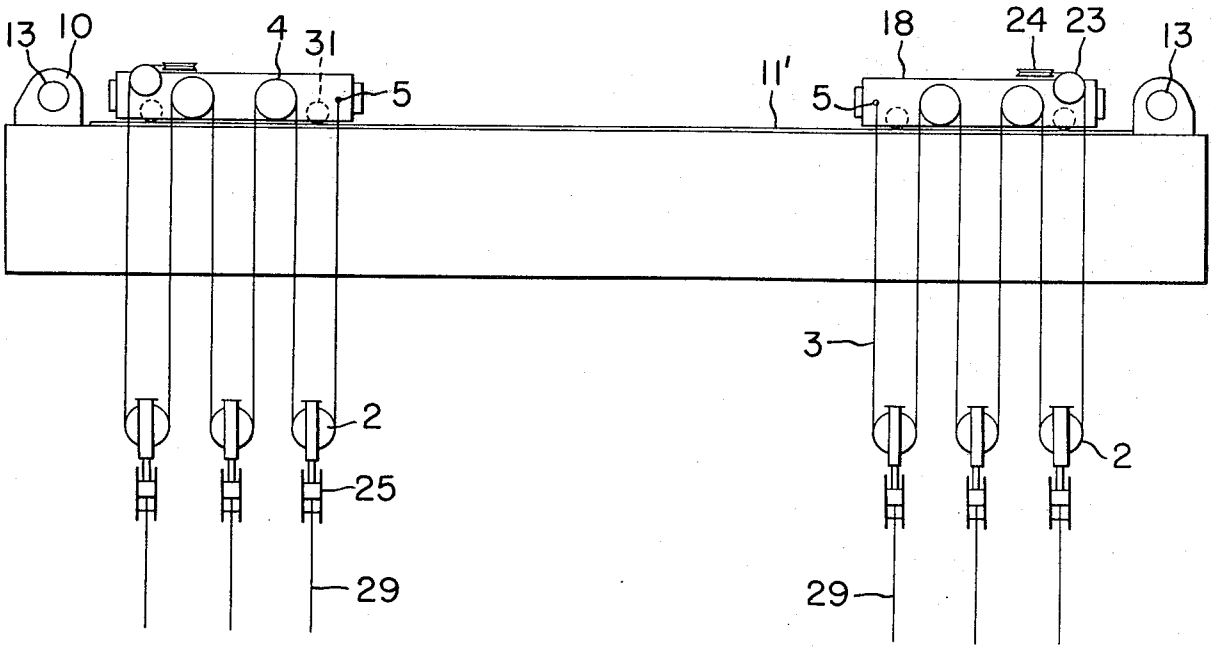

In the embodiment shown in FIGS. 8*a* an 8*b*, the block loader is provided with two self-propelled carriers on a box-shaped beam 11′. As shown in FIG. 8*a*, each carrier rotatably carries a plurality of movable pulleys 2 at each end of the beam 11′. A wire rope 3 wound around a wire rope fastening pin 5 at one end of the carrier is passed over movable pulleys 2 and the stationary pulleys 4, over guide pulleys 23 and 24 and over movable pulleys 2 and stationary pulleys 4 on the opposite side of the beam 11′ and it is then fastened to another fastening pin 5 (not shown) on the opposite side. Each pair of the associated movable pulleys is connected to an equalizer 25 by means of fixing pins 26, and a sling rope 29 for attaching at its one end a clamp (not shown) is secured to one end of the equalizer 25 through a hanger pin 27. Abutment 18 is provided so that when the unused equalizer 25 is pulled up, the abutment comes into contact with the lower surface of the beam 11′ to securely hold the equalizer 25 against the beam. The carriers are respectively provided with a self-propelling mechanism 30 which may be a gear motor including a reduction gear and a torque limiter. Carrier wheels 31 are independently suspended by coil springs to fully support the dead load of the carrier and float it from the beam. In case a block is suspended from the ropes 29, however, the lower frame of the carrier comes into close contact with flat rails 32 and thus the load of the block directly acts on the beam. In this way, when the loader body is inclined, the carriers are prevented from moving automatically.

While the invention has been illustrated and described by means of specific embodiments, it will be understood by those skilled in the art that various changes and modifications may be made by considerating the basic idea of the invention without departing from the scope and spirit of the invention. For instance, in the double-beam type block loader shown in FIG. 3, each of the connecting means may be comprised of a beam member including at least one group of movable pulleys, or alternately the wire ropes may be connected to combine the two groups of the movable pulleys on the separate beams on each of the both sides of FIG. 3 and in this way the loader body may be provided with a group of the movable pulleys on each side thereof. Further, the connecting means used in the embodiments of FIGS. 4 through 6 may be replaced with rigid bars which are extended through beams in similar manner as the disk of the barbell or alternately the beams may be mounted on connecting bars, thereby movably supporting the two beams on the bars. Still further, in the block loaders shown in FIGS. 7 and 8, each carrier may be provided with more than two groups of movable pulleys, or alternately more than two beams may be arranged in the same horizontal plane to movably mount one or more carriers on each beam.

What we claim is:

1. A loader for lifting a block with multiple hanging points, comprising a loader body including at least one beam, and at least two movable pulley groups mounted on the beam, each movable pulley group including an array of stationary pulleys arranged along the beam, wire rope fastening means at each end of the array of stationary pulleys, a movable pulley between adjacent ones of the stationary pulleys and between the wire rope fastening means and the stationary pulleys adjacent thereto, respectively, each movable pulley having a hanger ring at one end thereof for attachment to a respective one of the block hanging points, and a wire rope passed alternately over the movable and stationary pulleys, the wire rope having one end thereof attached to one of the fastening means and the other end thereof attached to the other one of the fastening means, whereby the movable pulleys in each group share the load of the block equally.

2. A block loader according to claim 1, wherein the loader body comprises a plurality of coplanar beams connected with each other.

3. A block loader according to claim 2, comprising a plurality of parallel connecting means interconnecting the beams to form a frame.

4. A block loader according to claim 3, wherein the beam connecting means are adapted to expand and contract to vary the frame width of the loader body.

5. A block loader according to claim 1, further comprising an abutment plate member on the upper portion of each movable pulley whereby, when the movable pulley is not employed for block lifting, it is firmly held against the lower surface of the loader body to rest thereat.

6. A block loader according to claim 1, further comprising an extended pulley shaft for each movable pulley whereby, when the movable pulley is not used for block lifting, it is firmly held against the lower surface of the loader body to rest thereat.

7. A loader for lifting a block with multiple hanging points, comprising a beam loader body, a plurality of stationary pulleys rotatable mounted on the loader body directly, a wire rope fastening pin provided at each end of the loader body and at selected positions between the ends, a wire rope passed over the stationary pulleys arranged between an associated pair of the pins in such a manner that a loop of the wire rope is formed between the stationary pulleys and between each pin and stationary pulley adjacent thereto, and a movable pulley suspended on each of the loops of the wire rope and having a hanger ring at one end thereof for attachment to a respective one of the block hanging points, whereby at least two groups of the movable pulleys having the wire rope passed thereover are provided on the loader body.

8. A loader for lifting a block with multiple hanging points, comprising a loader body including at least one beam and a plurality of carrier means movable along the beam in side-by-side arrangement, at least one group of movable pulleys mounted on each of the carrier means, each movable pulley group including a pair of wire rope fastening means on the carrier means, a plurality of stationary pulleys rotatably mounted on the carrier means along the beam between the pair of fastening means, a movable pulley between adjacent ones of the stationary pulleys and between the fastening means and the stationary pulleys adjacent thereto, respectively, each movable pulley having a hanger ring at one end thereof for attachment to a respective one of the block hanging points, and a wire rope passed alternately over the movable and stationary pulleys, the wire rope having one end thereof attached to one of the fastening means and the other end thereof attached to the other one of the fastening means.

9. A block loader according to claim 8, wherein each of the carrier means is self-propelled.

* * * * *